US008602370B2

(12) United States Patent
McKenzie

(10) Patent No.: US 8,602,370 B2
(45) Date of Patent: Dec. 10, 2013

(54) HANGER HOLDER ACCESSORY AND SYSTEM

(76) Inventor: Martha McKenzie, Eufaula, AL (US)

( * ) Notice: Subject to any disclaimer, the term of this patent is extended or adjusted under 35 U.S.C. 154(b) by 0 days.

(21) Appl. No.: 13/095,399

(22) Filed: Apr. 27, 2011

(65) Prior Publication Data

US 2012/0273636 A1 Nov. 1, 2012

(51) Int. Cl.
*A47B 96/06* (2006.01)

(52) U.S. Cl.
USPC ..... 248/215; 248/339; 248/340

(58) Field of Classification Search
USPC ..... 248/27.8, 153, 175, 249, 465.1, 207, 248/214, 215, 231.81, 231.85, 317, 322, 248/339, 340, 316.7; 211/57.1, 90.03, 106, 211/119.004, 59.1; 312/4; 206/300
See application file for complete search history.

(56) References Cited

U.S. PATENT DOCUMENTS

| | | | | | |
|---|---|---|---|---|---|
| 2,459,909 | A | * | 1/1949 | Alofs | 248/214 |
| 2,925,916 | A | * | 2/1960 | Pollock | 211/119.004 |
| 3,598,064 | A | * | 8/1971 | Stempel | 108/2 |
| 3,693,808 | A | * | 9/1972 | Rauch | 211/195 |
| 3,789,778 | A | * | 2/1974 | Brand | 108/94 |
| 3,855,943 | A | * | 12/1974 | Larson | 108/28 |
| 3,985,325 | A | * | 10/1976 | Ginsburg et al. | 248/220.22 |
| 4,196,880 | A | * | 4/1980 | Hynes | 248/99 |
| 4,303,163 | A | * | 12/1981 | Henry | 211/133.4 |
| 4,667,912 | A | * | 5/1987 | DeVilbiss | 248/97 |
| 4,775,054 | A | * | 10/1988 | Dixon | 211/57.1 |
| 5,172,824 | A | * | 12/1992 | Stutler | 220/495.08 |
| 5,326,062 | A | * | 7/1994 | Remmers | 248/250 |
| 5,427,340 | A | * | 6/1995 | Stromsmoe et al. | 248/97 |
| 5,875,902 | A | * | 3/1999 | Emery et al. | 211/90.03 |
| 5,894,940 | A | * | 4/1999 | Gusdorf et al. | 211/35 |
| 5,924,578 | A | * | 7/1999 | McKenzie | 211/49.1 |
| 6,129,222 | A | * | 10/2000 | Mylander et al. | 211/106 |
| D494,844 | S | * | 8/2004 | Klein et al. | D8/372 |
| 6,889,855 | B2 | * | 5/2005 | Nagel | 211/59.3 |
| 7,118,001 | B2 | * | 10/2006 | Klein et al. | 211/90.03 |
| D534,065 | S | * | 12/2006 | Andre et al. | D8/395 |
| 7,377,396 | B2 | * | 5/2008 | Keen | 211/49.1 |
| 7,617,941 | B2 | * | 11/2009 | Colin et al. | 211/59.2 |
| 7,775,492 | B2 | * | 8/2010 | Pierzynski et al. | 248/220.43 |
| 7,828,144 | B2 | * | 11/2010 | Bentley et al. | 206/300 |
| 8,177,736 | B2 | * | 5/2012 | Kopperschmidt | 604/6.16 |
| 2004/0007549 | A1 | * | 1/2004 | Klein et al. | 211/118 |
| 2006/0067661 | A1 | * | 3/2006 | Pierzynski et al. | 396/71 |

* cited by examiner

*Primary Examiner* — Terrell McKinnon
*Assistant Examiner* — Eret McNichols
(74) *Attorney, Agent, or Firm* — Epstein Drangel LLP; Robert L. Epstein

(57) ABSTRACT

An apparatus is provided for attaching an accessory to a hanger holder for holding at least one hanger. The hanger holder has a frame and first and second hanger supports extending from spaced points on the frame. The apparatus includes a first arrangement having a top portion for receiving an end of the accessory, and a second arrangement, arranged adjacent and parallel to the first arrangement, for receiving a section of the frame of the hanger holder in a lengthwise opening. A device is provided for attaching an accessory to a hanger holder. The device includes a first receiving element adapted to receive a first end of the accessory, and a second receiving element arranged adjacent and parallel to the first receiving element and adapted to receive in a lengthwise opening a section of a frame of the hanger holder.

16 Claims, 3 Drawing Sheets

HANGER HOLDER ACCESSORY AND SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hanger holders, and in particular relates to an accessory for a hanger holder.

2. Background of the Invention

Clothing hangers made of wood, plastic, metal or combinations thereof are in common use in the home. Empty hangers must be stored for use when needed. The empty hangers can be hung on the closet bar, along with those which are in use. However, storage of empty hangers in this way takes up limited closet space.

In order not to occupy hanging space, empty hangers could be stacked on a shelf in the closet or on the closet floor. However, hangers kept in such a manner tend to become tangled, making it difficult to extract a single hanger when needed. Hangers stored in this manner may also take up space needed for the storage of other things.

U.S. Pat. No. 5,924,578 relates to a hanger holder that includes first and second rods extend from spaced points on an open frame. The rods support a plurality of hangers situated in parallel planes. When the frame is mounted on a wall such that the rods extend horizontally, the hangers are retained on the rods by upwardly bent end sections. A third rod may be provided to engage the hanger near the point where the hook is attached. In one preferred embodiment, the upwardly bent end sections of the first and second rods are connected by an arcuate section and the third rod is joined to the arcuate section. A cover enclosing the hangers is employed in another preferred embodiment.

BRIEF SUMMARY OF THE INVENTION

An apparatus is provided for attaching an accessory to a hanger holder for holding at least one hanger. The hanger holder has a frame and first and second hanger supports extending from spaced points on the frame. The apparatus includes a first arrangement having a top portion for receiving an end of the accessory, and a second arrangement, arranged adjacent and parallel to the first arrangement, for receiving a section of the frame of the hanger holder. The second arrangement includes a lengthwise opening adapted to receive the section of the frame.

The accessory may be a hook extending away from the frame. The first arrangement may define a first tubular space and the first end of the accessory may be substantially cylindrical. The second arrangement may define a second tubular space and the section of the frame of the hanger holder may be substantially cylindrical. A first diameter of the first end of the accessory may be substantially equal to a second diameter of the section of the hanger holder frame.

The frame may include a bend adjacent to the section of the frame. A further section of the frame opposite the bend from the section may be adapted to interact with a bottom portion of the apparatus to prevent movement of the apparatus after installation of the apparatus on the hanger holder. The bottom portion of the apparatus may be opposite the top end. The second arrangement may include a recess at the bottom portion, and the recess may be adapted to receive the further section of the frame.

The accessory may include a bend adjacent to the end, a portion of the accessory opposite the end from the bend being adapted to interact with the top end of the apparatus to prevent movement of the accessory after installation of the apparatus on the hanger holder. The first arrangement may include a recess at the top end, and the recess may be adapted to receive the portion of the accessory.

The opening may further allow removal of the section of the frame. The apparatus may be formed from one piece of an elastic material.

A device is provided for attaching an accessory to a hanger holder. The device includes a first receiving element adapted to receive a first end of the accessory, and a second receiving element arranged adjacent and parallel to the first receiving element. The second receiving element is adapted to receive in a lengthwise opening a section of a frame of the hanger holder.

The first receiving element may define a first tubular space and the first end of the accessory may be substantially cylindrical. The second receiving element may define a second tubular space and the section of the frame of the hanger holder may be substantially cylindrical. A first diameter of the first end of the accessory may be substantially equal to a second diameter of the section of the frame of the hanger holder.

The frame may include a bend adjacent to the section of the frame, and a further section of the frame opposite the bend from the section may be adapted to interact with a bottom end of the apparatus to prevent movement of the apparatus after installation of the apparatus on the hanger holder. The bottom end of the apparatus may be opposite the top end. The second receiving element may include a recess at the bottom end, and the recess may be adapted to receive the further section of the frame.

The accessory may include a bend adjacent to the end, and a portion of the accessory opposite the end from the bend may be adapted to interact with the top end of the apparatus to prevent movement of the accessory after installation of the apparatus on the hanger holder. The first receiving element may include a recess at the top end, and the recess may be adapted to receive the portion of the accessory.

The accessory may be a hook extending away from the wall, and the device may be formed from one piece of an elastic material.

A holder is provided for at least one hanger. The holder includes a base comprising frame rods, and first and second hanger support rods extend in a plane from spaced points on the base. The first and second rods are connected by an arcuate section. At least a portion of the arcuate section is inclined relative to the plane. The holder further includes an apparatus for attaching an accessory to the holder. The apparatus includes a first arrangement having a top end for receiving an end of the accessory, and a second arrangement arranged adjacent and parallel to the first arrangement. The second arrangement receives a section of the base of the hanger holder, and includes a lengthwise opening. The opening is adapted to receive the section of the base.

The holder may further include a third rod extending from the base to the arcuate section, and an arrangement for mounting the base on a vertical surface.

The holder may further include a device for attaching the holder to a door. The device may include a first arrangement for receiving a top edge of a door, the first arrangement may include first and second plates connected by a top plate. The first and second plates may be parallel to each other and perpendicular to the top plate. The first receiving arrangement may be adapted to receive a top edge of a door. The top edge of the door may abut the top plate. The device may further include a second arrangement for receiving a top section of the base. The second arrangement may include a hook opening upward and adapted to receive a portion of one of the frame rods.

These objects and the details of the invention will be apparent from the following description and accompanying drawings.

DETAILED DESCRIPTION OF THE INVENTION

The present invention relates to a device for the storage of clothing hangers and more particularly to a clothing hanger holder adapted to be mounted on a wall or shelf and which includes retaining means to prevent accidental dislodgement of the hangers. In particular, the present invention provides an apparatus for attaching an accessory to a hanger holder. The accessory may be a hook.

The device provided may be a nylon clip that holds a hook that may be used to hang anything a user wants, and in particular may be used for temporarily hanging clothes when doing laundry. The nylon clip connects to the hanger holder using an open slot and to the hanging hook with a closed tube section.

The hanging hook may be the same diameter as the hanger holder. A groove in one end of the closed tube section of the nylon clip may provide a stable orientation for the hanging hook with respect to the nylon clip.

The nylon clip may also stabilize the position of the hanger holder, for instance by a friction relationship with the door or wall to which the hanger holder is affixed.

The nylon clip's orientation with respect to the hanging holder may be stabilized by a groove or by the shape of the contact between the nylon clip and the door or wall to which the hanger holder is affixed. The contact between the device and a door may keep the hanging hook perpendicular to the door.

Figure 1A:
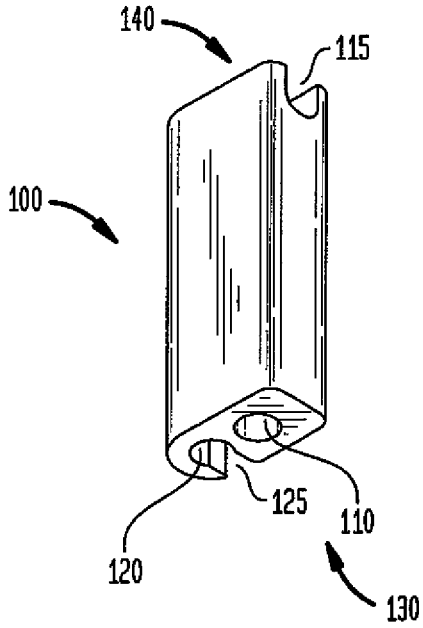
FIG. 1*a* is a perspective view of an accessory according to an exemplary embodiment of the present invention.

FIG. 1*a* is a perspective view of accessory 100. Accessory 100 defines first tubular space 110 and second tubular space 120. First tubular space 110 and second tubular space 120 may have substantially a same diameter. First tubular space 110 may extend from first end 130 of accessory 100 to second end 140 of accessory 100, and may be enclosed for substantially the entire length. Second end 140 may also be referred to herein as a top end of accessory 100, and first end 130 may also be referred to herein as a bottom end of accessory 100. First tubular space 110 may be adapted to receive an end of a hanger hook that may be inserted in second end 140 of first tubular space 110, and may include groove 115 on that end. In this manner, a hook attached to accessory 100 by first tubular space 110 may have a fixed orientation with respect to accessory 100 by the bend in the hook being received in groove 115.

Second tubular space 120 may extend from first end 130 of accessory 100 to second end 140 of accessory 100, and may include opening 125, which may extend along the entire length of second tubular space 120. Second tubular space 120 may be adapted to receive a portion of a frame of a hanger holder that may be inserted in opening 125. In this manner, accessory 100, and additionally perhaps a hook, may be attached to a hanger holder. The hook attached to accessory 100 may have a fixed orientation with respect to the hanger holder.

Figure 1B:
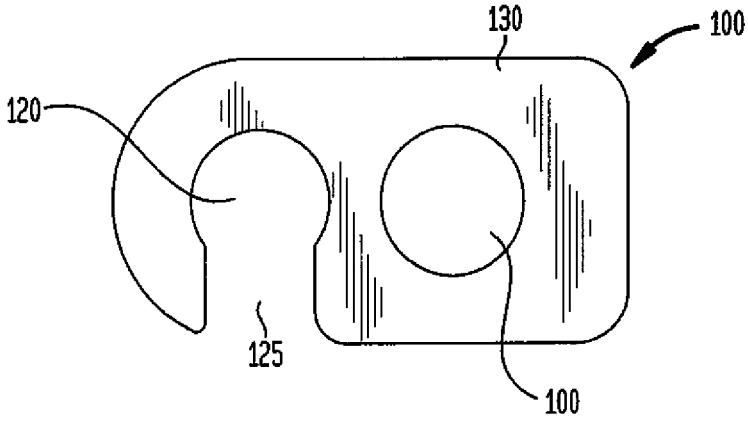
FIG. 1*b* is a bottom view of the accessory according to an exemplary embodiment shown in FIG. 1*a;*

FIG. 1*b* is a bottom view of accessory 100 showing first end 130 of accessory 100. First tubular space 110 and second tubular space 120 may have openings on first end 130 that are substantially a same diameter. First tubular space 110 and second tubular space 120 may be substantially parallel along a length of accessory 100 extending from first end 130 to second end 140.

Figure 2:
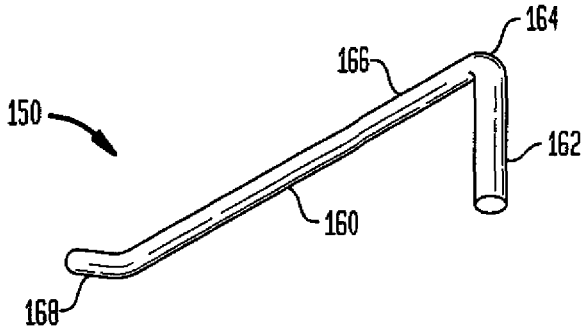
FIG. 2 is a perspective view of a hanger hook according to an exemplary embodiment of the present invention.

FIG. 2 is a perspective view of hanger hook 150. Hanger hook 150 may be made of plastic or metal, plastic covered metal, or any other appropriate material. In particular, hanger hook 150 may be made from a rod of metal (with or without a plastic outer layer) having a consistent diameter and bent into the shape of hanger hook 150. Hanger hook 150 may include central body 160 and upturned hook 168 on one end. On the opposite end of central body 160, hanger hook 150 may include section 162 that is adapted to be received in first tubular space 110 of accessory 100. Immediately adjacent to section 162 is bend 164 and then section 166. Bend 164 is adapted to be received in groove 115, and section 166 may rest on a portion of groove 115 to stabilize hanger hook 150 with respect to accessory 100.

Figure 3:
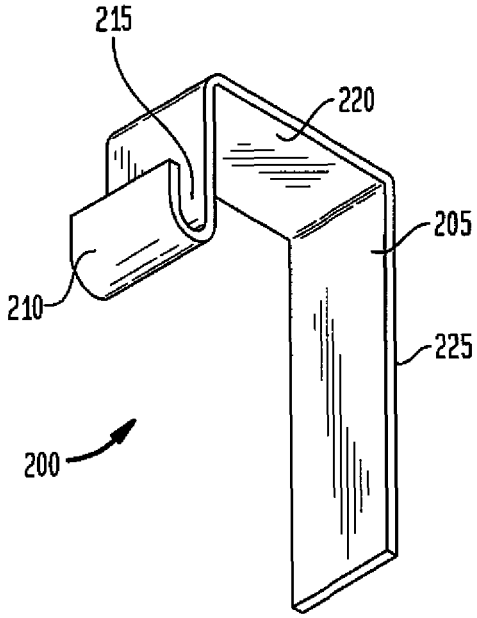
FIG. 3 is a perspective view of a door bracket according to an exemplary embodiment of the present invention.

FIG. 3 is a perspective view of door bracket 200. Door bracket 200 may be made of plastic or metal, plastic covered metal, or any other appropriate material. In particular, door bracket 200 may be made from a flat sheet of metal (with or without a plastic outer layer) having a consistent thickness and bent into the shape of door bracket 200. Door bracket 200 may include central body 205 and back plate 225 on one end. Adjacent to back plate 225, and separated from back plate 225 by a bend, is top door plate 220 of central body 205. Adjacent to top door plate 220, and separated from top door plate 220 by another bend, is hook 210 defining interior hook space 215. Interior hook space 215 is able to accommodate a portion of a frame of a hanger holder, and therefore has a diameter substantially equal to or greater than a diameter of the frame of a hanger holder. Door bracket 200 may therefore accommodate a frame of a hanger holder and attach a hanger holder to a door by placing door bracket 200 over a door such that top door plate 220 rests on top of the door, back plate 225 rests against one side of the door, and hook 210 rests against the other side of the door.

Figure 4A:
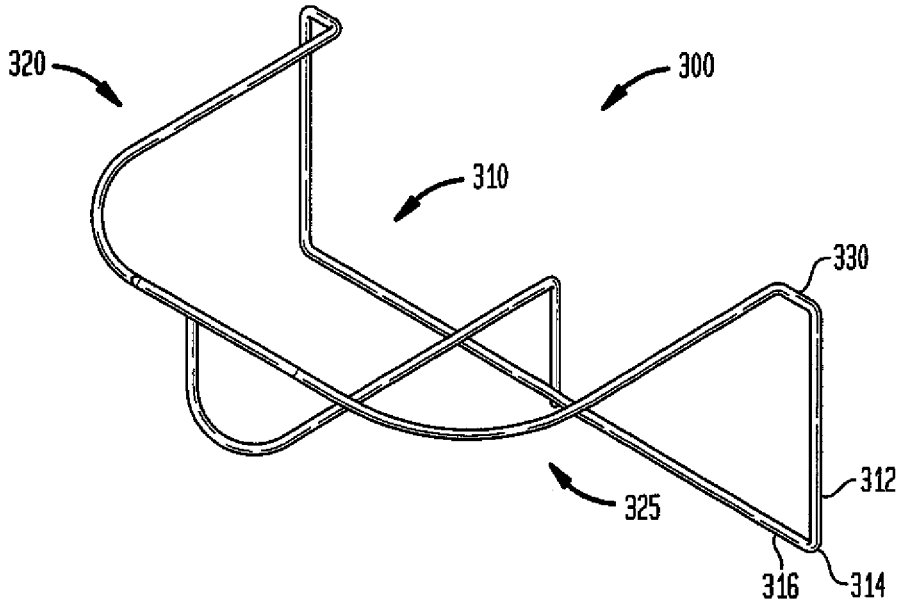
FIG. 4*a* is a perspective view of a hanger holder according to an exemplary embodiment of the present invention.

FIG. 4*a* is a perspective view of hanger holder 300. Hanger holder 300 may have a rod construction and may be manufactured from one or more rods being bent into a desired shape. Hanger holder 300 may be metal or plastic, metal coated with plastic, or any other appropriate material. Hanger holder 300 includes door stabilizing frame 310 and hanger holding frame 320. Door stabilizing frame 310 may form part or all of a rectangle or other trapezoid, or any other appropriate shape, and may be designed to rest substantially flat against a door surface. Hanger holding frame 320 may be designed to project out from a door surface when door stabilizing frame 310 is against a door surface, and may provide a structure that allows the storage of hangers. In particular, hanger holding frame 320 may include frame 325 adapted to receive a hanger or hangers for storage. Door stabilizing frame 310 may include bracket section 330 in an area of the top of door stabilizing frame 310, and adapted to be inserted in, or rest on, a door bracket, which in turn may rest on the top of a door to hold hanger holder 300. Door stabilizing frame 310 may also include lower frame bend 314 in an area of the bottom of door stabilizing frame 310. Lower frame bend 314 may connect vertical frame section 312 and horizontal frame section 316. Vertical frame section 312 may be adapted to receive an accessory holder, which may in turn be prevented from sliding downward by either lower frame bend 314 and/or horizontal frame section 316.

Figure 4B:
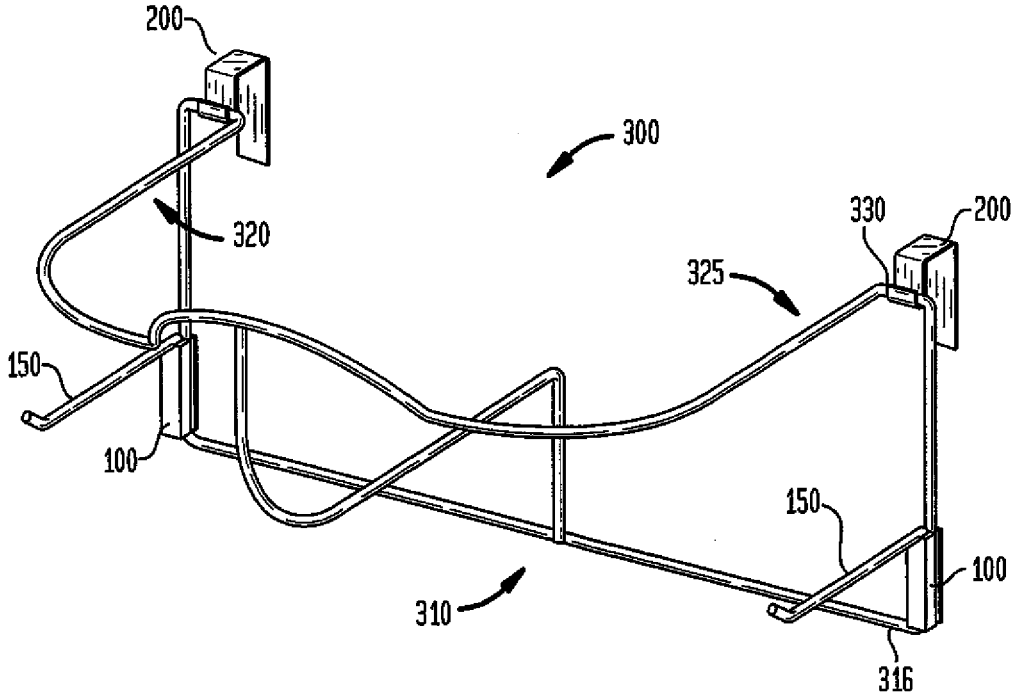
FIG. 4*b* is a perspective view of a hanger holder including two accessories, two hanger hooks, and two door brackets according to an exemplary embodiment of the present invention.

FIG. 4*b* is a perspective view of hanger holder 300 including two accessories 100 with corresponding hanger hooks 150, and two door brackets 200. Hanger holder 300 includes door stabilizing frame 310 and hanger holding frame 320. Hanger holding frame 320 may include frame 325 adapted to receive a hanger or hangers for storage. Door stabilizing frame 310 may include bracket section 330 in an area of the top of door stabilizing frame 310. Bracket section 330 may be adapted to be inserted in, or rest on, door bracket 200, which in turn may rest on the top of a door to hold hanger holder 300.

Door stabilizing frame 310 may also include horizontal frame section 316. A portion of door stabilizing frame may be adapted to receive accessory 100, which may in turn be prevented from sliding downward by horizontal frame section 316. Accessory 100 may hold hanger hook 150 in an orientation projecting out from the door and stabilized by a stable interaction between hanger hook 150 and accessory 100, and also by a stable interaction between accessory 100 and door stabilizing frame 310.

It should now be appreciated that the present invention provides an accessory item for a clothing hanger holder.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

I claim:

1. In combination, a holder for a clothing hanger comprising a frame, said frame comprising a base frame member and first and second upstanding frame members connected to and extending from different ends of said base frame member, said base frame member and said upstanding frame members defining a plane, an arcuate frame member extending from said plane and adapted to receive a clothing hanger, a supporting frame member connected to and extending from said base frame member to said arcuate frame member, an accessory adapted to be removably mounted to one of said upstanding frame members, said accessory comprising first and second substantially orthogonal rod sections, and means for removably mounting said accessory to one of said upstanding frame members, said mounting means comprising an elongated body comprising first and second ends and a side, a substantially tubular recess in said body adapted to receive said first rod section, such that said second rod section lies in a plane substantially orthogonal to said plane, and a substantially tubular opening in said body extending between said body ends and being open to said body side, said tubular opening being adapted to engage said one upstanding frame member.

2. The hanger holder of claim 1 further comprising a frame member section extending from one of said upstanding frame members substantially in said plane.

3. The combination of claim 2 further comprising a bracket for mounting said hangar holder frame on a door, said bracket comprising means for supporting one of said frame sections.

4. The hanger holder of claim 1 further comprising first and second frame member sections extending from said upstanding frame members respectively, in substantially opposite directions substantially in said plane.

5. The hanger holder of claim 4 wherein said arcuate frame member is connected to and extends between said first and second frame sections.

6. The combination of claim 4 further comprising first and second brackets for mounting said hangar holder frame on a door, each of said brackets comprising means for supporting a different one of said frame sections.

7. The combination of claim 1 further comprising means for fixing the orientation of said rod relative to said body.

8. The combination of claim 1 further comprising a groove in one end of said body adapted to receive at least a portion of said second rod section.

9. The combination of claim 1 wherein said rod further comprises a third rod section, wherein said third rod section is inclined upwardly relative to said second rod section.

10. In combination, a holder for a clothing hanger comprising a frame, said frame comprising a base frame member and first and second upstanding frame members connected to and extending from different ends of said base frame member, said base frame member and said upstanding frame members defining a plane, first and second frame member sections extending from said upstanding frame members respectively, in substantially opposite directions substantially in said plane, an arcuate frame member extending between said frame sections and adapted to receive a clothing hanger, a supporting frame member connected to and extending from said base frame member to said arcuate frame member, and first and second brackets for mounting said hangar holder frame on a door, each of said brackets comprising means for engaging the top of a door and means for supporting a different one of said frame sections, further comprising an accessory adapted to be removably mounted to one of said upstanding frame members, said accessory comprising first and second substantially orthogonal rod sections, and means for removably mounting said accessory to one of said upstanding frame members and wherein said mounting means comprising an elongated body comprising first and second ends and a side, a substantially tubular recess in said body adapted to receive said first rod section, and a substantially tubular opening in said body extending between said body ends and being open to said body side.

11. The hanger holder of claim 10 wherein said tubular opening is adapted to engage said one upstanding frame member and extends in a direction substantially parallel to said recess.

12. In combination, a holder for a clothing hanger comprising a frame, said frame comprising a base frame member and first and second upstanding frame members connected to and extending from different ends of said base frame member, said base frame member and said upstanding frame members defining a plane, first and second frame member sections extending from said upstanding frame members, respectively, in substantially opposite directions substantially in said plane, an arcuate frame member extending between said frame sections and adapted to receive a clothing hanger, a supporting frame member connected to and extending from said base frame member to said arcuate frame member, an accessory adapted to be removably mounted to one of said upstanding frame members, said accessory comprising first and second substantially orthogonal rod sections, and means for removably mounting said accessory to one of said upstanding frame members, said mounting means comprising an elongated body comprising first and second ends and a side, a substantially tubular recess in said body adapted to receive said first rod section, such that said second rod section lies in a plane substantially orthogonal to said plane, a substantially tubular opening in said body extending between said body ends and being open to said body side, said tubular opening being adapted to engage said one upstanding frame member, and first and second brackets for mounting said hanger holder frame on a door, each of said brackets comprising means for engaging the top of a door and means for supporting a different one of said frame sections.

13. The combination of claim 12 further comprising means for fixing the orientation of said rod relative to said body.

14. The combination of claim 12 further comprising a groove in one end of said body adapted to receive at least a portion of said second rod section.

15. The combination of claim 12 wherein said rod further comprises a third rod section, wherein said third rod section is inclined upwardly relative to said second rod section.

16. The hanger holder of claim 12 wherein said tubular opening extends in a direction substantially parallel to said recess.

* * * * *